United States Patent [19]

Crook et al.

[11] Patent Number: 4,699,562

[45] Date of Patent: Oct. 13, 1987

[54] EXTENDABLE DIPPERSTICK FOR EXCAVATORS AND BACKHOES

[76] Inventors: James D. Crook, 615 Palo Alto, Redlands, Calif. 92373; Laurence B. Miller, 13336 Debby St., Van Nuys, Calif. 91401

[21] Appl. No.: 865,945

[22] Filed: May 19, 1986

Related U.S. Application Data

[63] Continuation of Ser. No. 543,511, Oct. 19, 1983, abandoned.

[51] Int. Cl.[4] ..... B66C 23/04

[52] U.S. Cl. ..... 414/718; 212/269; 414/728

[58] Field of Search ..... 414/718, 728; 212/269

[56] References Cited

U.S. PATENT DOCUMENTS

| | | | |
|---|---|---|---|
| 3,178,046 | 4/1965 | Lull | 414/718 |
| 3,245,559 | 4/1966 | Russell | 414/718 X |
| 3,516,553 | 6/1970 | Reske | 212/269 |
| 3,748,807 | 7/1973 | Sterner | 414/718 X |
| 3,837,502 | 9/1974 | Hornagold | 212/269 X |
| 4,045,923 | 9/1977 | Shanmugasundaram | 212/269 X |
| 4,255,076 | 3/1981 | Svenning | 414/718 X |
| 4,442,922 | 4/1984 | Johannson | 212/269 X |
| 4,544,321 | 10/1985 | Lanier | 212/269 X |

*Primary Examiner*—Robert J. Spar
*Assistant Examiner*—Jay I. Alexander
*Attorney, Agent, or Firm*—Harris, Kern, Wallen & Tinsley

[57] ABSTRACT

An extendible dipperstick for excavators and backhoes. The dipperstick includes a telescoping member mounted to a main housing. The telescoping member includes a telescoping housing and a plate attached to one surface, forming flanges with respect thereto. The telescoping member is slidably attached to the housing by means of clamping bars and roller bearings attached to the main housing, which contact the flanges and the exterior surface of the plate, respectively.

2 Claims, 4 Drawing Figures

EXTENDABLE DIPPERSTICK FOR EXCAVATORS AND BACKHOES

This application is a continuation of application Ser. No. 543,511, filed Oct. 19, 1983, now abandoned.

BACKGROUND OF THE INVENTION

This invention is directed to extendible dipper sticks for excavators and backhoes. More specifically, it is directed to a dipperstick with a telescoping member that carries an implement such as an excavating bucket.

Excavators and backhoes are machines used for digging purposes, generally comprised of a tractor carrying a boom that can be pivotally manipulated, the boom in turn carrying a pivotally attached dipperstick. The dipperstick is in effect a secondary boom, carrying an excavating bucket or other implement on one end which is manipulated for digging purposes.

Dippersticks that are extendible are in general comprised of two major components, namely a main housing and a telescoping member. The housing is connected to the boom, and the telescoping member carries the excavating bucket. The bucket is attached pivotally to the end farther from the boom, and is manipulated by a driving means, usually a hydraulic cylinder (bucket cylinder) attached to the telescoping member, the telescoping member itself being extended and retracted by means of another driving means (such as a hydraulic extension cylinder) carried by said main housing.

A common configuration of the telescoping member and main housing is coaxial, with the telescoping member and extension cylinder within the main housing. It is desirable to hold the bucket or other implement in fixed relationship with respect to the telescoping member as the latter is extended and retracted, and since the main housing is in general not large enough to accommodate the bucket cylinder, which controls said relationship, the bucket cylinder must be connected to the telescoping member from without the main housing. For this purpose a slot is often provided, running the length of the main housing, through which the bucket cylinder and telescoping member may be connected. A problem caused by this approach is the structural weakening of the main housing caused by the slot, resulting in premature wear of the housing. If the housing is formed from heavier material to counteract this structural weakness, the construction is made more expensive and the added weight requires greater energy in the manipulation of the main housing while excavating. A further problem caused by this arrangement is that the length of the slot limits the range over which the telescoping member can be extended or retracted. Since the bucket cylinder, as abovementioned, is connected to the telescoping member through the slot, the range of movement of the telescoping member is defined by the points at which the means for such connection abuts either end of the slot. This limits the range over which excavation may be had for a given position of the excavator or backhoe, and places undesirable limitations on the length of the dipperstick's power stroke, lessening its utility, especially when digging in heavy soils.

Another method of attaching the bucket cylinder (on the exterior of the main housing) to the telescoping member (on the interior of and coaxial to the main housing) is to provide a means for carrying the bucket cylinder attached to the telescoping member only at the end that protrudes from the main housing, i.e. adjacent the bucket, and to stabilize said means by slidably attaching it to the main housing at the end thereof closer to the boom. A problem with this configuration is that such a bucket-carrying means adds expense and weight to the telescoping extension, making it less efficient to operate. Moreover, this configuration entails more wear surfaces, requiring greater maintenance.

An attempt to avoid these problems involves a configuration wherein the bucket cylinder is carried by the telescoping member by a means contained within the main housing, such as in the invention disclosed by Beaton in U.S. Pat. No. 3,700,126. The result is that the housing must therefore be made with a larger diameter to accommodate said means, adding weight, cost and inefficiency to the device. Furthermore, the connection between the bucket cylinder and the bucket or implement must be made closer to the pivotal axis of the bucket, requiring higher torque for bucket rotation and therefore more strain on the bucket cylinder.

Another variation of dipperstick utilizes a telescoping member that is coaxial with but exterior to an inner member, which inner member is connected to the boom. This type of device is shown in the invention disclosed by Sampo et al in U.S. Pat. No. 3,445,015. This solves some of the problems of the reverse configuration, but creates the problem of having a larger, heavier telescoping member, requiring greater energy to drive and putting greater strain on the smaller, lighter inner member. Another problem with this variation is that the retraction of the telescoping member is limited by the point at which the inner member is connected to the boom, making the retracted configuration less compact overall and limiting both the digging range of the excavator or backhoe and the length of the power stroke when breaking earth.

In all of these dipperstick devices there is the problem of constant wear on the telescoping member and the main housing (or the inner member in Sampo) due to the sliding friction encountered in operation. In coaxial configurations relatively little volume may be utilized for friction-reducing devices, because greater volume requires greater amount and weight of materials.

It is therefore an object of this invention to provide an extendible dipperstick for excavators and backhoes wherein the main housing and telescoping member are not coaxial.

Another object of this invention is to provide an extendible dipperstick wherein the bucket cylinder is carried by the telescoping member without structural weakening of the main housing.

A further object of this invention is to provide an extendible dipperstick wherein the bucket cylinder is carried by the telescoping member without the necessity of an additional bucket-carrying structure contacting or sliding against the main housing, allowing for lower weight, less materials, and less maintenance.

An additional object of this invention is to provide an extendible dipperstick wherein the main housing and telescoping member are slidably attached in a noncoaxial parallel fashion.

It is another object of this invention is to provide an extendible dipperstick wherein wear due to friction between the telescoping member and main housing is minimized through the use of bearings.

A further object of this invention is to provide an extendible dipperstick wherein the telescoping member is relatively light with respect to the main housing, allowing for less strain on the main housing and greater efficiency in operating the telescoping extension.

An additional object of this invention is to provide an extendible dipperstick wherein the bucket cylinder is carried by the telescoping extension without increasing the torque required to manipulate the bucket or implement, allowing for reduced strain on the bucket cylinder and related structure.

Another object of this invention is to provide an extendible dipperstick wherein the range of movement of the telescoping member is limited neither by the means for mounting the dipperstick to the boom nor by the means for connecting the bucket cylinder to the telescoping member, allowing for greater digging range and a longer power stroke.

A further object of this invention is to provide an extendible dipperstick which may utilize a telescoping extension cylinder for extending and retracting the telescoping member, thereby further increasing said digging range and power stroke.

Other objects, advantages, features and results will more fully appear in the course of the following description.

SUMMARY OF THE INVENTION

An extendible dipperstick for excavators and backhoes comprising a main housing and a telescoping member. The main housing is carried pivotally by the boom of the excavator or backhoe, and the telescoping member is carried slidably by the main housing. The telescoping member includes a telescoping housing with a plate attached to one surface thereof, the plate being wider than said telescoping housing and forming flanges with respect thereto. The flanges have interior surfaces (i.e. formed by the surface of the plate facing the telescoping housing) which engage clamping bars connected to the main housing. The plate has an exterior surface which contacts roller bearings mounted on the main housing. Thus, the telescoping member is slidably carried by the main housing, held in place by the clamping bars and the roller bearings, which reduce friction in operation.

DESCRIPTION OF THE PREFERRED EMBODIMENT

Figure 1:
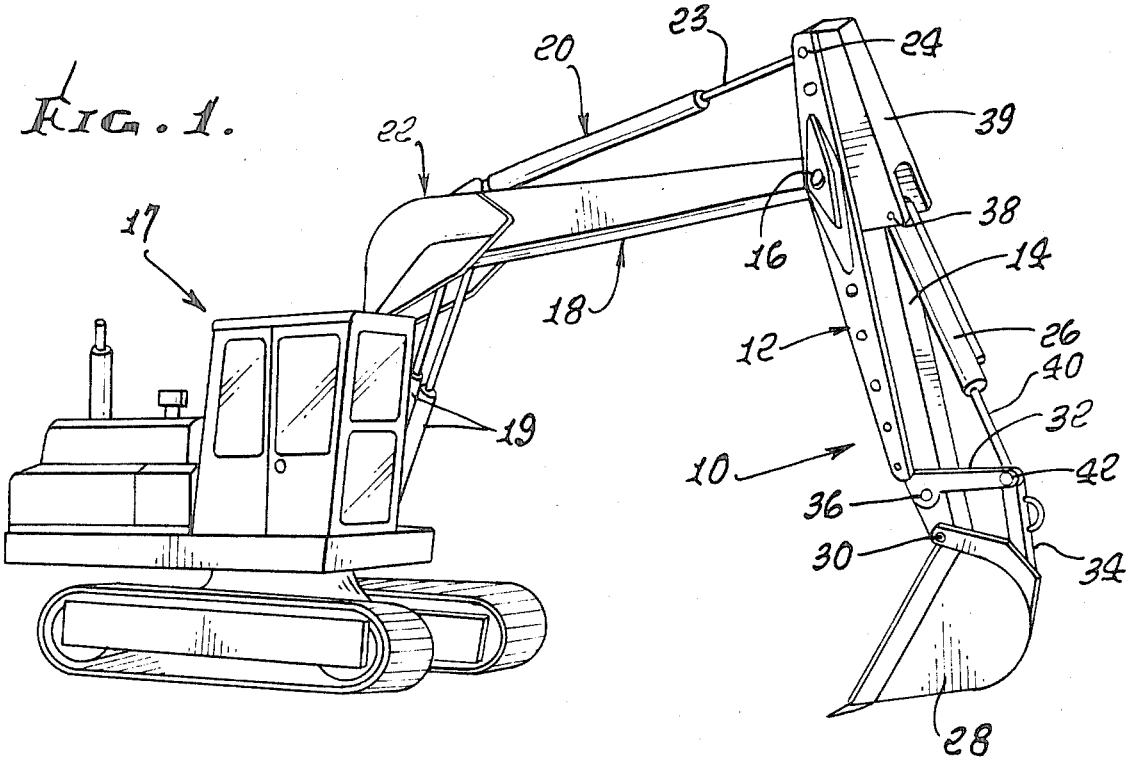
FIG. 1 is a perspective view of an excavator or backhoe with a dipperstick attached thereto, and incorporating the presently preferred embodiment of the invention.
Figure 4:
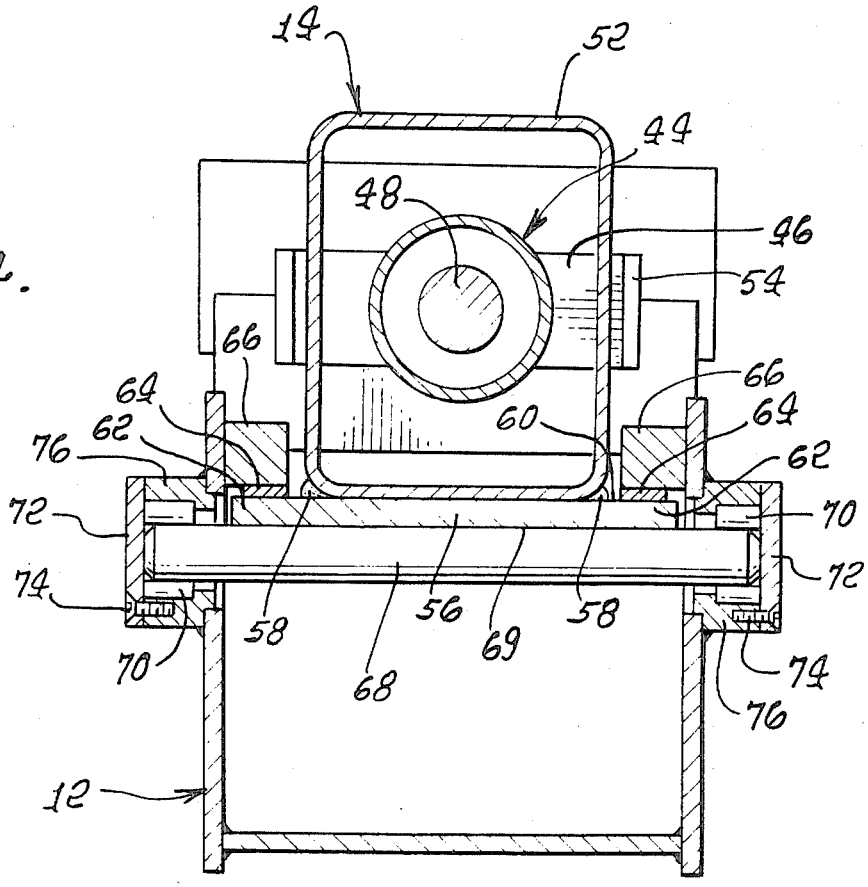
FIG. 4 is an enlarged sectional view taken along line 4—4 of FIG. 2.

Referring to FIG. 1, the dipperstick 10 comprises a main housing 12 and a telescoping member 14. The housing 12 is pivotally attached at pivot 16 to the boom 18 of the excavator or backhoe 17, which boom 18 is manipulated by a boom cylinder or cylinders 19. The boom 18 carries a crowd cylinder 20 pivotally attached to the boom 18 at pivot 22 and carrying a ram 23 attached pivotally to the dipperstick 10 at pivot 24. The crowd cylinder is hydraulically operated for manipulating the dipperstick in a conventional manner.

The telescoping member 14 carries a bucket cylinder 26 and an implement such as an excavating bucket 28. The bucket 28 is pivotally attached to the telescoping member at pivot 30 and via links 32 and 34 at pivot 36. The bucket cylinder 26 is connected at pivot 38 to a bucket cylinder support 39 carried by the telescoping member 14, and includes a ram 40 attached pivotally to links 32 and 34 at pivot 42. The bucket cylinder 26 is operated hydraulically for manipulating the bucket 28 in a conventional manner. The bucket cylinder 26 is seen in its contracted position in FIG. 2 and in a partially extended position in FIGS. 1 and 3.

It should now be evident that the retracted and extended positions of the telescoping member 14 are limited neither by the pivot 16 nor by the pivot 38. Rather, the boom end of the telescoping member 14 may actually protrude beyond the boom 18 in its retracted position, as shown in FIG. 1, thereby increasing the digging range and the power stroke of the dipperstick over earlier configurations.

Figure 2:
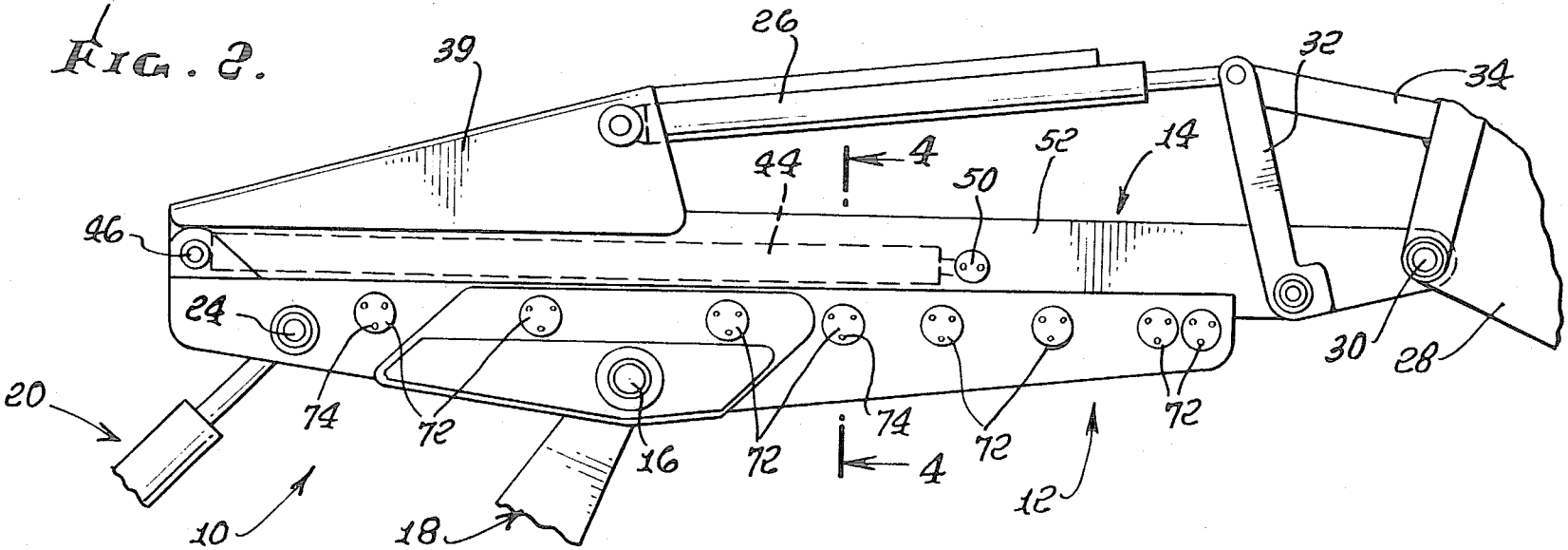
FIG. 2 is an enlarged elevation view of the dipperstick of FIG. 1 in the retracted position.
Figure 3:
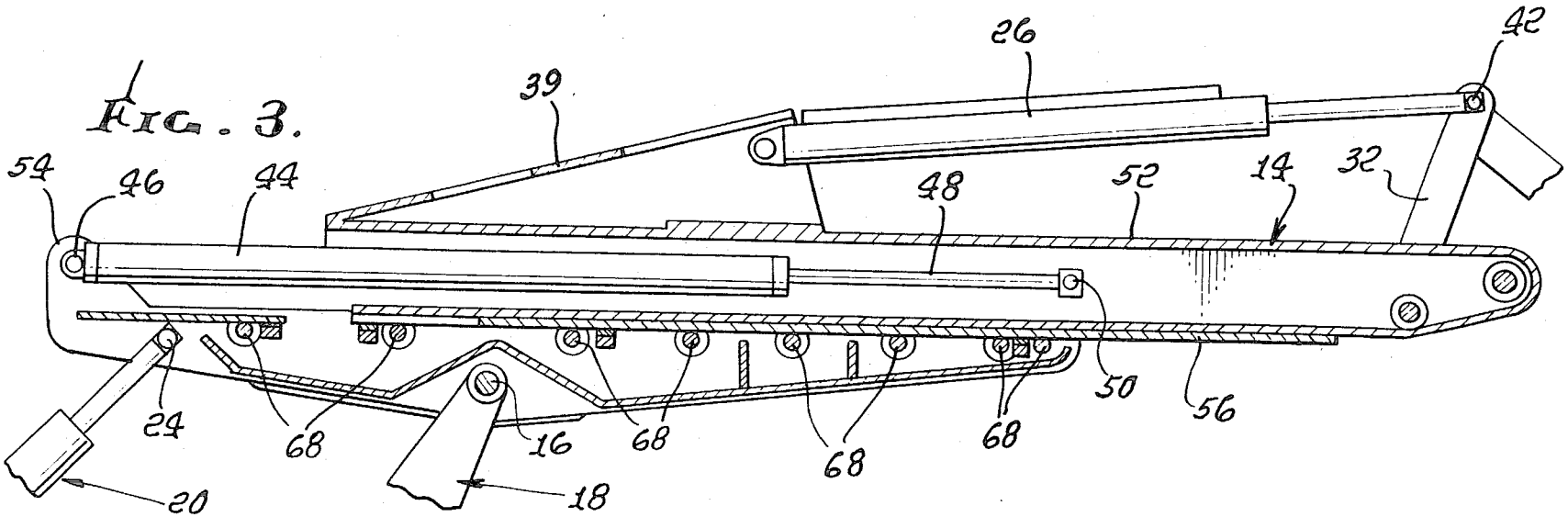
FIG. 3 is an elevation view, partly in section, of the dipperstick of FIG. 1 in a partially extended position.

Referring now to FIGS. 2 and 3, it will be seen that the dipperstick 10 also includes an extension cylinder 44, or other appropriate driving means, for extending and retracting the telescoping member. The extension cylinder 44 is attached to flanges 54 of the main housing 12 at extension cylinder support 46. The extension cylinder 44 carries a ram 48 attached to telescoping housing 52 of the telescoping member 14 at extension cylinder support 50. The telescoping housing 52 carries a plate 56 permanently affixed by spot welds 58 or the equivalent. The interior surface 60 of the plate 56, i.e. the surface facing the telescoping housing, forms flanges 62 with respect to the telescoping housing 52. These flanges 62 contact wear strips 64, which may be made of any suitable material such as brass, and which are attached to clamping bars 66, the clamping bars 66 in turn being attached to the main housing 12. Thus, the clamping bars 66 exert pressure on the flanges 62 of the plate 56 and indirectly on the telescoping member 52. The clamping bars 66 and wear strips 64 are of approximately the same length as the main housing 12.

In another configuration of the invention, the extension cylinder 44 may be made shorter than shown in FIGS. 2 and 3, allowing for a greater retraction range. Another configuration of the invention includes an extension cylinder 44 of a telescoping type, thus increasing the extension range. Because, as aforementioned, the pivots 16 and 38 do not limit the retraction and extension range of the telescoping member, use of a shorter extension cylinder 44 that is also of a telescoping type takes best advantage of the digging range and power stroke capabilities of this invention.

Alternatively, the wear strips 64 may be attached to the flanges 62 of the plate 56, in which case they will be of approximately the same length as the plate 56.

The main housing 12 carries roller bearings 68, mounted on ball bushings 70, which may be of a self-adjusting type. The roller bearings 68 are held in place by roller retaining caps 72 which are attached by bolts 74 or other suitable means to ball bushing housings 76, which housings 76 are in turn attached by suitable means to the main housing 12. The roller bearings 68 contact and exert pressure on the exterior surface 69 of the plate 56, thus, in conjunction with the clamping bars 66, holding the plate 56 (and indirectly the telescoping member 14) in place.

It will be apparent from the foregoing description that as the extension cylinder 44 is extended, the telescoping member 14 slides forward with respect to the main housing 12, the exterior surface 69 of the plate 56 causing the roller bearings 68 to rotate, substantially reducing the friction between the plate 56 and the main housing 12. It is also apparent that the area of wear strips 64 should be small relative to the area of the exterior surface of the plate 56 in order to minimize friction.

As is now apparent, excavation is accomplished by manipulation of the boom cylinder or cylinders 19, the crowd cylinder 20, the extension cylinder 44 and the bucket cylinder 26. In operation, the boom cylinder or cylinders adjust the angle of the boom with respect to the excavator or backhoe 17; the crowd cylinder adjusts the angle of the dipperstick with respect to the boom 18; the extension cylinder 44 extends or retracts the telescoping member 14 with respect to the main housing 12 of the dipperstick 10; and the bucket cylinder 26 controls the rotation of the bucket 28 for excavating.

Various modifications and alternative embodiments of the foregoing disclosure may be made without departing from the spirit and scope of this invention.

We claim:

1. A dipperstick for.excavators and backhoes, comprising in combination:

a main housing for pivotal attachment to a boom of an excavator or backhoe;

at least four roller bearings carried by and enclosed within said housing, with said roller bearings positioned at intervals over substantially the entire length of said main housing;

a telescoping member slidably attached to said main housing in a parallel noncoaxial configuration, said telescoping member including a plate with a lower surface contacting said roller bearings during extension or retraction to reduce friction, said telescoping member including a telescoping housing which carries said plate, said plate forming flanges with respect to said telescoping housing, with said main housing carrying clamping bars contacting said flanges and with said clamping bars and roller bearings effectively holding said telescoping member in a slidable relationship with respect to said main housing such that said plate lower surface contacts each of said four roller bearings within said main housing;

wear strips positioned between said clamping bars and flanges, and attached to said clamping bars; and a driving means positioned within said telescoping member for extending and retracting said telescoping member.

2. A dipperstick for excavators and backhoes, comprising in combination:

a main housing for pivotal attachment to a boom of an excavator or backhoe;

at least four roller bearings carried by and enclosed within said housing, with said roller bearings positioned at intervals over substantially the entire length of said main housing;

a telescoping member slideably attached to said main housing in a parallel noncoaxial configuration, said telescoping member including a plate with a lower surface contacting said roller bearings during extension or retraction to reduce friction, said telescoping member including a telescoping housing which carries said plate, said plate forming flanges with respect to said telescoping housing, with said main housing carrying clamping bars contacting said flanges and with said clamping bars and roller bearings effectively holding said telescoping member in a slidable relationship with respect to said main housing such that said plate lower surface contacts each of said four roller bearings within said main housing;

wear strips positioned between said clamping bars and flanges, and attached to said flanges; and a driving means positioned within said telescoping member for extending and retracting said telescoping member.

* * * * *